US008163168B2

(12) United States Patent
Gorbaty et al.

(10) Patent No.: US 8,163,168 B2
(45) Date of Patent: Apr. 24, 2012

(54) PROCESS FOR FLEXIBLE VACUUM GAS OIL CONVERSION

(75) Inventors: Martin L. Gorbaty, Westfield, NJ (US); Bruce R. Cook, Aurora, IL (US); David T. Ferrughelli, Flemington, NJ (US); Jason B. English, Baton Rouge, LA (US); Steven S. Lowenthal, Flanders, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 540 days.

(21) Appl. No.: 12/459,729

(22) Filed: Jul. 7, 2009

(65) Prior Publication Data

US 2010/0018895 A1 Jan. 28, 2010

Related U.S. Application Data

(60) Provisional application No. 61/135,956, filed on Jul. 25, 2008.

(51) Int. Cl.
*C10G 69/04* (2006.01)

(52) U.S. Cl. ..... 208/55; 208/50; 208/52 R; 208/52 CT; 208/54; 208/67; 208/73; 208/76; 208/125; 208/131; 208/132; 208/208 R

(58) Field of Classification Search ..... 208/50, 208/52 R, 52 CT, 54–55, 67, 73, 76, 125, 208/131–132, 113–124, 208 R, 209–217
See application file for complete search history.

(56) References Cited

U.S. PATENT DOCUMENTS

| | | | | |
|---|---|---|---|---|
| 2,343,192 | A | 2/1942 | Kuhn | |
| 4,016,218 | A | 4/1977 | Haag et al. | |
| 4,230,533 | A | 10/1980 | Giroux | |
| 4,311,579 | A | 1/1982 | Bartholic | |
| 4,443,325 | A | 4/1984 | Chen et al. | |
| 4,569,753 | A | 2/1986 | Busch et al. | |
| 4,582,569 | A | 4/1986 | Jenkins | |
| 4,695,367 | A * | 9/1987 | Ezernack et al. | 208/106 |
| 4,892,644 | A | 1/1990 | Choi et al. | |
| 4,933,067 | A | 6/1990 | Rankel | |
| 5,468,369 | A * | 11/1995 | Muldowney | 208/113 |
| 5,755,933 | A | 5/1998 | Ognisty et al. | |
| 2007/0034550 | A1 | 2/2007 | Hedrick et al. | |

FOREIGN PATENT DOCUMENTS

| | | |
|---|---|---|
| EP | 0239074 | 9/1987 |

* cited by examiner

*Primary Examiner* — Walter D Griffin
*Assistant Examiner* — Brian McCaig
(74) *Attorney, Agent, or Firm* — Bruce M. Bordelon

(57) ABSTRACT

The present invention relates to a process for the selective conversion of hydrocarbon feed having a Conradson Carbon Residue content of 0 to 6 wt %, based on the hydrocarbon feed. The hydrocarbon feed is treated in a two-step process. The first is thermal conversion and the second is catalytic cracking of the products of the thermal conversion. The present invention results in a process for increasing the distillate production from a hydrocarbon feedstream for a fluid catalytic cracking unit. The resulting product slate from the present invention can be further varied by changing the conditions in the thermal and catalytic cracking steps as well as by changing the catalyst in the cracking step.

19 Claims, 6 Drawing Sheets

Comparison of Naphtha and Distillate Yields (Paraffinic VGO)

Comparison of Naphtha and Distillate Yields (Naphthenic VGO)

Comparison of Naphtha and Distillate Yields (Hydrotreated Naphthenic VGO)

PROCESS FOR FLEXIBLE VACUUM GAS OIL CONVERSION

This application claims the benefit of U.S. Provisional Application No. 61/135,956 filed Jul. 25, 2008.

FIELD OF THE INVENTION

The present invention relates to a process for the selective conversion of hydrocarbon feed having a Conradson Carbon Residue content of 0 to 6 wt %, based on the hydrocarbon feed. The hydrocarbon feed is treated in a two-step process. The first is thermal conversion and the second is catalytic cracking of the products of the thermal conversion. The present invention results in a process for increasing the distillate production from a hydrocarbon feedstream for a fluid catalytic cracking unit. The resulting product slate from the present invention can be further varied by changing the conditions in the thermal and catalytic cracking steps as well as by changing the catalyst in the cracking step.

BACKGROUND OF THE INVENTION

The upgrading of atmospheric and vacuum residual oils (resids) to lighter, more valuable products has been accomplished by thermal cracking processes such as visbreaking and coking. In visbreaking, a vacuum resid from a vacuum distillation column is sent to a visbreaker where it is thermally cracked. The process conditions are controlled to produce the desired products and minimize coke formation. Vacuum gas oils from the vacuum distillation column are typically sent directly to a fluidized catalytic cracking (FCC) unit. The products from the visbreaker have reduced viscosity and pour points, and include naphtha, visbreaker gas oils and visbreaker residues. The bottoms from the visbreaker are heavy oils such as heavy fuel oils. Various processing schemes have been incorporated with visbreakers. The amount of conversion in visbreakers is a function of the asphaltene and Conradson Carbon Residue (or "CCR") content of the feed. Generally, lower levels of asphaltene and CCR content in the hydrocarbon feed are favorable to visbreaking. Higher values of asphaltene and CCR content lead to increased coking and lower yields of light liquids.

Petroleum coking relates to processes for converting resids to petroleum coke and hydrocarbon products having atmospheric boiling points lower than that of the feed. Some coking processes, such as delayed coking, are batch processes where the coke accumulates and is subsequently removed from a reactor vessel. In fluidized bed coking, for example fluid coking and FLEXICOKING® (available from ExxonMobil Research and Engineering Co., Fairfax, Va.), lower boiling products are formed by the thermal decomposition of the feed at elevated reaction temperatures, typically from about 480 to 590° C. (896 to 1094° F.), using heat supplied by burning some of the fluidized coke particles.

Following coking, the lower boiling hydrocarbon products, such as coker gas oil, are separated in a separation region and conducted away from the process for storage or further processing. Frequently, the separated hydrocarbon products contain coke particles, particularly when fluidized bed coking is employed. Such coke particles may range in size upwards from submicron to several hundred microns in diameter, but typically are in the submicron to about 50 micron diameter range. It is generally desirable to remove particles larger than about 25 microns in diameter to prevent fouling of downstream catalyst beds used for further processing. Filters, located downstream of the separation zone, are employed to remove coke from the products. Solid hydrocarbonaceous particles present in the separated lower boiling hydrocarbon products may physically bind to each other and the filters, thereby fouling the filter and reducing filter throughput. Fouled filters must be back-washed, removed and mechanically cleaned, or both to remove the foulant.

There is a need in the industry for improved processes for treating high boiling range hydrocarbon feeds such as vacuum gas oils in order to increase the production of distillate boiling range products produced from these hydrocarbon feeds.

SUMMARY OF THE INVENTION

A preferred embodiment of the present invention is a thermal and catalytic conversion process for converting a hydrocarbon feed having a Conradson Carbon Residue ("CCR") content of from 0 to 6 wt %, based on the hydrocarbon feed, which comprises:

a) processing the hydrocarbon feed in a thermal conversion zone under effective thermal conversion conditions to produce a thermally cracked product;

b) separating the thermally cracked product into a thermally cracked bottoms fraction and a lower boiling fraction containing at least one of naphtha and distillate;

c) conducting at least a portion of the lower boiling fraction to a fractionator;

d) conducting at least a portion of the thermally cracked bottoms fraction to a reactor riser of a fluid catalytic cracking unit where it contacts a cracking catalyst;

e) catalytically converting the thermally cracked bottoms fraction under fluid catalytic cracking conditions to produce a catalytically cracked product;

f) conducting the catalytically cracked product to the fractionator; and g) separating a naphtha product, a distillate product, and a fractionator bottoms product from the fractionator.

In more preferred embodiment of the present invention, at least a portion of the hydrocarbon feed is hydrotreated prior to processing in the thermal conversion zone.

In another more preferred embodiment of the present invention, at least a portion of the fractionator bottoms product is recycled back to the reactor riser. In yet another more preferred embodiment of the present invention, at least a portion of the naphtha product is recycled back to the reactor riser.

In yet another more preferred embodiment, the thermal conversion zone is operated at a severity in the range of 25-450 equivalent seconds at 468° C.

DETAILED DESCRIPTION OF THE INVENTION

Feedstock

Figure 1:
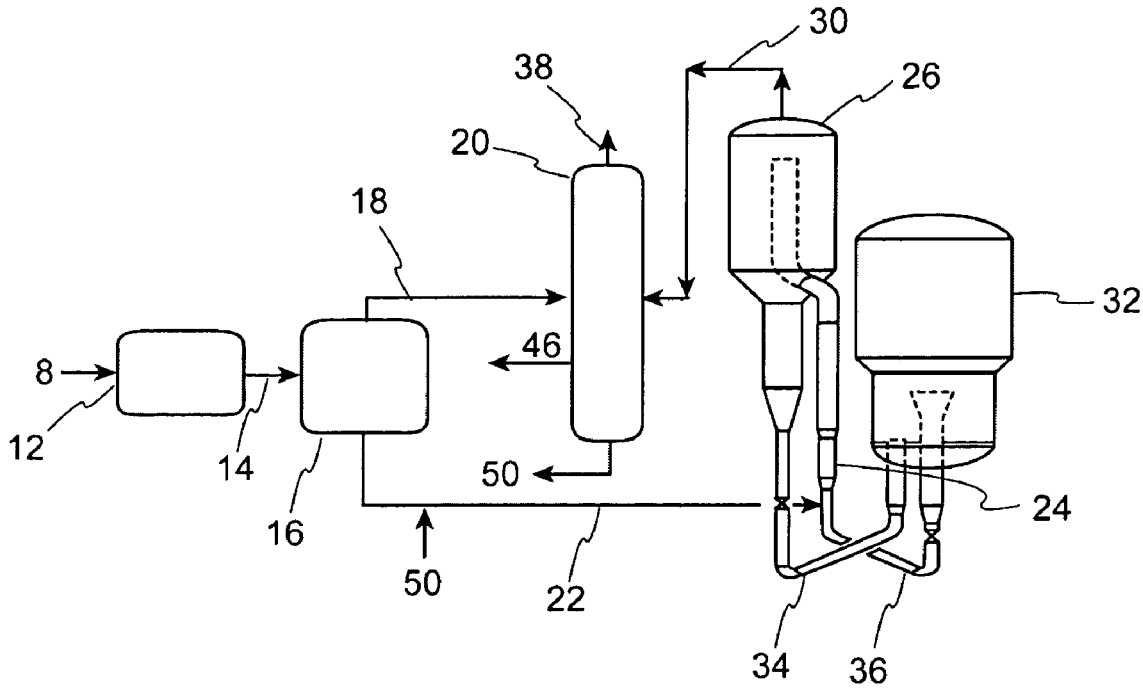
FIG. 1 is a flow diagram showing an embodiment of the present invention wherein a hydrocarbon feed is subjected to a thermal conversion followed by catalytic cracking to produce an improved distillate yield.

The feedstock to the present thermal and catalytic conversion process is a hydrocarbon feed having a Conradson Carbon Residue ("CCR") content of from 0 to 6 wt %, based on the hydrocarbon feed. The Conradson Carbon Residue ("CCR") content of a stream is defined herein as equal to the value as determined by test method ASTM D4530, Standard Test Method for Determination of Carbon Residue (Micro Method). Examples of preferred hydrocarbon feeds include vacuum gas oils and hydrotreated vacuum gas oils. By vacuum gas oil (VGO) is meant a hydrocarbon fraction wherein at least 90 wt % of the hydrocarbon fraction boils in the range of about 343° C. to about 566° C. (650° F. to 1050° F.) as measured by ASTM D 2887. Unless otherwise noted herein, all boiling point temperatures are referenced at atmospheric pressure. The normal source of vacuum gas oils are vacuum distillation towers but the precise source of the VGO as defined herein is not important. It is preferred that the hydrocarbon feed be suitable as a feed to the FCC unit. Hydrocarbon feeds having >1 wt % CCR may include a resid component wherein resids are defined herein as hydrocarbon fractions boiling above about 566° C. (1050° F.). VGOs are typically low in CCR content and low in metal content. CCR as defined herein is determined by standard test method ASTM D189. The feedstock to the thermal conversion zone may be heated to the necessary reaction temperature by an independent furnace or by the feed furnace to the FCC unit itself.

Thermal Conversion

The hydrocarbon feed having a CCR of about 0 to 6 wt % is first thermally converted in a thermal conversion zone. VGOs fractions tend to be low in CCR and metals, and when the hydrocarbon feed contains a substantial about of VGO fraction hydrocarbons, the thermal conversion zone can be operated at more severe conditions while limiting the production of excessive coke, gas make, toluene insolubles, or reactor wall deposits as compared to a typical vacuum resid feed that is thermally cracked. The conditions for thermal conversion zone to achieve maximum distillate production will vary depending on the nature of the products desired. In general, the thermal conversion zone may be operated at temperatures and pressures to maximize the desired product without making and depositing undesirable amounts of coke, coke precursors or other unwanted carbonaceous deposits in the thermal conversion zone. These conditions are determined experimentally and are generally expressed as a severity which is dependent upon both the temperature and residence time of the hydrocarbon feed in the thermal conversion zone.

Severity has been described as equivalent reaction time (ERT) in U.S. Pat. Nos. 4,892,644 and 4,933,067 which patents are incorporated by reference herein in their entirety. As described in U.S. Pat. No. 4,892,644, ERT is expressed as a time in seconds of residence time at a fixed temperature of 427° C., and is calculated using first order kinetics. The ERT range in the U.S. Pat. No. 4,892,644 patent is from 250 to 1500 ERT seconds at 427° C., more preferably at 500 to 800 ERT seconds. As noted by patentee, raising the temperature causes the operation to become more severe. In fact, raising the temperature from 427° C. to 456° C. leads to a five fold increase in severity.

In the present invention, a similar methodology is used to determine severities which are expressed in equivalent seconds at 468° C. (as compared to the 427° C. used in U.S. Pat. No. 4,892,644). In applicants' process, severities are in the range of 25-450 equivalent seconds at 468° C. Because applicants use a feed that is low in CCR, the present process can operate at severities higher than those described for visbreaking of a vacuum resid. The low CCR hydrocarbon feeds utilized herein have a lower tendency to form wall deposits and coke, and minimize the yield of poor quality naphthas that are produced in the thermal conversion.

Depending on the products desired, the skilled operator will control conditions including temperature, pressure, residence times and feed rates to achieve the desired product distribution. The type of thermal cracking unit may vary. It is preferred that the unit be run in a continuous mode.

Thermal Conversion Products

In one embodiment, the products from thermal conversion are conducted to a separator where the products may be separated into a thermally cracked bottoms fraction and a lower boiling fraction comprised of a hydrocarbon fraction selected from a naphtha and a distillate. The lower boiling fraction may also contain a thermally cracked $C_4$-fraction which may be separately isolated and sent to the fractionator with or without the naphtha and/or distillate fraction.

It should be noted herein that the term "naphtha" or "naphtha fraction" as used herein is defined as a hydrocarbon fraction wherein at least 90 wt % of the naphtha fraction boils in the range of about 15° C. to about 210° C. (59° F. to 430° F.) as measured by ASTM D 86. The term "distillate" or "distillate fraction" as used herein is defined as a hydrocarbon fraction wherein at least 90 wt % of the distillate fraction boils in the range of about 200° C. to about 343° C. (392° F. to 649° F.) as measured by ASTM D 86. The term "$C_4$-fraction" as used herein is defined as a hydrocarbon fraction wherein at least 90 wt % of the $C_4$-fraction boils at temperatures below 0° C. (32° F.) as measured by ASTM D 86.

The separation may be accomplished using conventional separators such as a flash tower or a distillation tower. The thermally cracked bottoms fraction contains higher boiling material, e.g., those fractions having a boiling point in excess of about 343° C. (650° F.). The lower boiling fraction can be sent to a fractionator for further separation into the product slate desired. The lower boiling fraction is comprised of a hydrocarbon fraction selected from a naphtha and a distillate and will have boiling points commensurate with these products. The thermally cracked bottoms fraction is sent to a FCC unit for catalytic cracking. In a further embodiment, the thermally cracked bottoms fraction may be combined with other FCC feeds prior to the FCC unit.

If the thermally cracked bottoms fraction contains undesirable amounts of S- and N-containing contaminants, then in a further embodiment of the present invention, at least a portion of the thermally cracked bottoms fraction may optionally be hydrotreated prior to being sent to the FCC unit. As mentioned previously, it is also an option that the starting feed may be sent to a hydrotreater to remove at least some of the sulfur and nitrogen contaminants prior to entering the process. Continuing with this embodiment, the thermally cracked bottoms fraction is contacted with hydrogen and a hydrotreating catalyst under conditions effective to remove at least a portion of the sulfur and/or nitrogen contaminants to produce a hydrotreated fraction. After hydrotreating, at least a portion of the hydrotreated fraction is sent to an FCC unit for further processing in accordance with this embodiment of the invention.

Hydrotreating catalysts suitable for use herein are those containing at least one Group 6 (based on the IUPAC Periodic Table having Groups 1-18) metal and at least one Groups 8-10 metal, including mixtures thereof. Preferred metals include Ni, W, Mo, Co and mixtures thereof. These metals or mixtures of metals are typically present as oxides or sulfides on refractory metal oxide supports. The mixture of metals may also be present as bulk metal catalysts wherein the amount of metal is 30 wt % or greater, based on the catalyst.

Suitable metal oxide supports include oxides such as silica, alumina, silica-alumina or titania, preferably alumina. Preferred aluminas are porous aluminas such as gamma or eta. The acidity of metal oxide supports can be controlled by adding promoters and/or dopants, or by controlling the nature of the metal oxide support, e.g., by controlling the amount of silica incorporated into a silica-alumina support. Examples of promoters and/or dopants include halogen, especially fluorine, phosphorus, boron, yttria, rare-earth oxides and magnesia. Promoters such as halogens generally increase the acidity of metal oxide supports while mildly basic dopants such as yttria or magnesia tend to decrease the acidity of such supports.

It should be noted that bulk catalysts typically do not include a support material, and the metals are not present as an oxide or sulfide but as the metal itself. These catalysts typically include metals within the range described above in relation to bulk catalyst and at least one extrusion agent. The amount of metals for supported hydrotreating catalysts, either individually or in mixtures, ranges from 0.5 to 35 wt %, based on the catalyst. In the case of preferred mixtures. of Group 6 and Groups 8-10 metals, the Group 8-10 metals are present in amounts of from 0.5 to 5 wt %, based on the catalyst and the Group 6 metals are present in amounts of from 5 to 30 wt % based on the catalyst. The amounts of metals may be measured by atomic absorption spectroscopy, inductively coupled plasma-atomic emission spectrometry or other methods specified by ASTM for individual metals. Non-limiting examples of suitable commercially available hydrotreating catalysts include RT-721, KF-840, KF-848, and Sentinel™. Preferred catalysts are low acidity, high metals content catalysts including KF-848 and RT-721.

In preferred embodiments, the thermally cracked bottoms fraction is subjected to hydrotreating conditions at temperatures of about 280° C. to about 400° C. (536 to 752° F.), more preferably about 300° C. to about 380° C. (572 to 716° F. and at pressures of about 1,480 to about 20,786 kPa (200 to 3,000 psig), more preferably about 2,859 to about 13,891 kPa (400 to 2,000 psig). In other preferred embodiments, the space velocity in the hydrotreating zone is from about 0.1 to about 10 LHSV, more preferably from about 0.1 to about 5 LHSV. Hydrogen treat gas rates of from about 89 to about 1,780 $m^3/m^3$ (500 to 10,000 scf/B), more preferably 178 to 890 $m^3/m^3$ (1,000 to 5,000 scf/B) may be utilized in the hydrotreating zone.

The FCC Process

A conventional FCC process includes a riser reactor and a regenerator wherein petroleum feed is injected into the reaction zone in the riser containing a bed of fluidized cracking catalyst particles. The catalyst particles typically contain zeolites and may be fresh catalyst particles, catalyst particles from a catalyst regenerator or some combination thereof. Gases that may be inert gases, hydrocarbon vapors, steam or some combination thereof are normally employed as lift gases to assist in fluidizing the hot catalyst particles.

Catalyst particles that have contacted feed produce product vapors and catalyst particles containing strippable hydrocarbons as well as coke. The catalyst exits the reaction zone as spent catalyst particles and is separated from the reactor's effluent in a separation zone. The separation zone for separating spent catalyst particles from reactor effluent may employ separation devices such as cyclones. Spent catalyst particles are stripped of strippable hydrocarbons using a stripping agent such as steam. The stripped catalyst particles are then sent to a regeneration zone in which any remaining hydrocarbons are stripped and coke is removed. In the regeneration zone, coked catalyst particles are contacted with an oxidizing medium, usually air, and coke is oxidized (burned) at temperatures typically in the range of about 650 to 760° C. (1202 to 1400° F.). The regenerated catalyst particles are then passed back to the riser reactor.

FCC catalysts may be amorphous, e.g., silica-alumina, crystalline, e.g., molecular sieves including zeolites, or mixtures thereof. A preferred catalyst particle comprises (a) an amorphous, porous solid acid matrix, such as alumina, silica-alumina, silica-magnesia, silica-zirconia, silica-thoria, silica-beryllia, silica-titania, silica-alumina-rare earth and the like; and (b) a zeolite such as a faujasite. The matrix can comprise ternary compositions, such as silica-alumina-thoria, silica-alumina-zirconia, magnesia and silica-magnesia-zirconia. The matrix may also be in the form of a cogel. Silica-alumina is particularly preferred for the matrix, and can contain about 10 to 40 wt % alumina. As discussed, promoters can be added. The catalyst zeolite component includes zeolites which are iso-structural to zeolite Y. These include the ion-exchanged forms such as the rare-earth hydrogen and ultrastable (USY) form. The zeolite may range in crystallite size from about 0.1 to 10 microns, preferably from about 0.3 to 3 microns. The amount of zeolite component in the catalyst particle will generally range from about 1 to about 60 wt %, preferably from about 5 to about 60 wt %, and more preferably from about 10 to about 50 wt %, based on the total weight of the catalyst. As discussed, the catalyst is typically in the form of a catalyst particle contained in a composite. When in the form of a particle, the catalyst particle size will typically range from about 10 to 300 microns in diameter, with an average particle diameter of about 60 microns. The surface area of the matrix material after artificial deactivation in steam will typically be $\leqq 350\ m^2/g$, more typically about 50 to 200 $m^2/g$, and most typically from about 50 to 100 $m^2/g$. While the surface area of the catalysts will be dependent on such things as type and amount of zeolite and matrix components used, it will usually be less than about 500 $m^2/g$, more typically from about 50 to 300 $m^2/g$, and most typically from about 100 to 250 $m^2/g$.

The cracking catalyst may also include an additive catalyst in the form of a medium pore zeolite having a Constraint Index (which is defined in U.S. Pat. No. 4,016,218) of about 1 to about 12. Suitable medium pore zeolites include ZSM-5, ZSM-11, ZSM-12, ZSM-22, ZSM-23, ZSM-35, ZSM-48, ZSM-57, SH-3 and MCM-22, either alone or in combination. Preferably, the medium pore zeolite is ZSM-5.

FCC process conditions in the reaction zone include temperatures from about 482° C. to about 740° C. (900 to 1364° F.); hydrocarbon partial pressures from about 10 to about 40 psia (69 to 276 kPa), preferably from about 20 to about 35 psia (138 to 241 kPa); and a catalyst to feed (wt/wt) ratio from about 3 to about 10, where the catalyst weight is total weight of the catalyst composite. The total pressure in the reaction zone is preferably from about atmospheric to about 50 psig (446 kPa). Though not required, it is preferred that steam be concurrently introduced with the feedstock into the reaction zone, with the steam comprising up to about 50 wt %, preferably from about 0.5 to about 5 wt % of the primary feed. Also, it is preferred that vapor residence time in the reaction zone be less than about 20 seconds, preferably from about 0.1 to about 20 seconds, and more preferably from about 1 to about 5 seconds. Preferred conditions are short contact time conditions which include riser outlet temperatures from 482-621° C. (900-1150° F.), pressures from about 0 to about 50 psig (101 to 446 kPa) and riser reactor residence times from 1 to 5 seconds.

It is well known that different feeds may require different cracking conditions. In the present process, if it is desired to make the maximum amount of distillate from the hydrocarbon feed, then the thermal cracker will be run at maximum temperature consistent with avoiding excess coke or coke precursor make. In an embodiment, at least a portion of the thermally cracked bottoms fraction separated from the thermal cracking product will be sent to a FCC unit. If it is desired to maximize distillate production, then the FCC catalyst formulation will be optimized for this. It is also known that the location of the injectors within the FCC unit, specifically the location in the FCC riser reactor, also influences the product slate. A further factor is whether there is a blending of different types of feeds to the FCC riser reactor.

The products from the FCC reactor are then sent to the cat fractionator where they and the lower boiling fraction are separated into a product slate including naphtha, distillate and bottoms. A portion of the products comprised of a $C_{4-}$ fraction is taken off the top of the fractionator and sent for further processing as desired. In an embodiment, at least a portion of the naphtha product stream may be optionally recycled back to the FCC reactor. In another embodiment, the bottoms from the fractionator can be recycled back to the FCC reactor for further processing.

One embodiment of the process according to the invention is further illustrated in FIG. 1. Here, a hydrocarbon feed with a Conradson Carbon Residue ("CCR") from about 0 to about 6 wt % (8) is fed to a thermal conversion zone (12). A thermal cracked product (14) is obtained from the thermal conversion zone (12) and is conducted to a separations tower (16). The separations tower (16) may be either a flash tower or a distillation tower. A separations tower overhead product (18) comprised of a fraction selected from a naphtha and a distillate is sent to a fractionator (20). At least a portion of the thermally cracked bottoms product (22) is conducted to the reactor riser (24) of a FCC reactor (26) where it contacts a fluidized catalyst and is cracked into lower boiling products. The FCC cracked products are separated from the catalyst in cyclones (not shown) and the cracked products (30) are conducted to the fractionator (20). Spent catalyst (34) is sent to the regenerator (32) where it is regenerated under regenerating conditions. Regenerated catalyst is returned the reactor riser (24) through the catalyst return line (36). The fractionator (20) separates product from the FCC reactor as well as lower boiling products containing naphtha and/or distillate from the separations tower (16) into a co-mingled thermal and FCC fractionator naphtha product (38), a co-mingled thermal and FCC distillate fractionator product (46), and a fractionator bottoms product (50). In this embodiment, the co-mingled thermal and FCC fractionator naphtha product (38), is preferably drawn from the overhead of the fractionator in which case the stream may also include $C_4$-hydrocarbons, including $C_3/C_4$ olefins which can be further separated from the naphtha range hydrocarbons. Although not shown in FIG. 1, in an embodiment, at least a portion of the fractionator bottoms product (50) may also be recycled back to the FCC reactor riser (24). In an additional embodiment, the feedstream to the reactor riser (24) may be supplemented by additional FCC hydrocarbon feedstreams (50).

Figure 2:
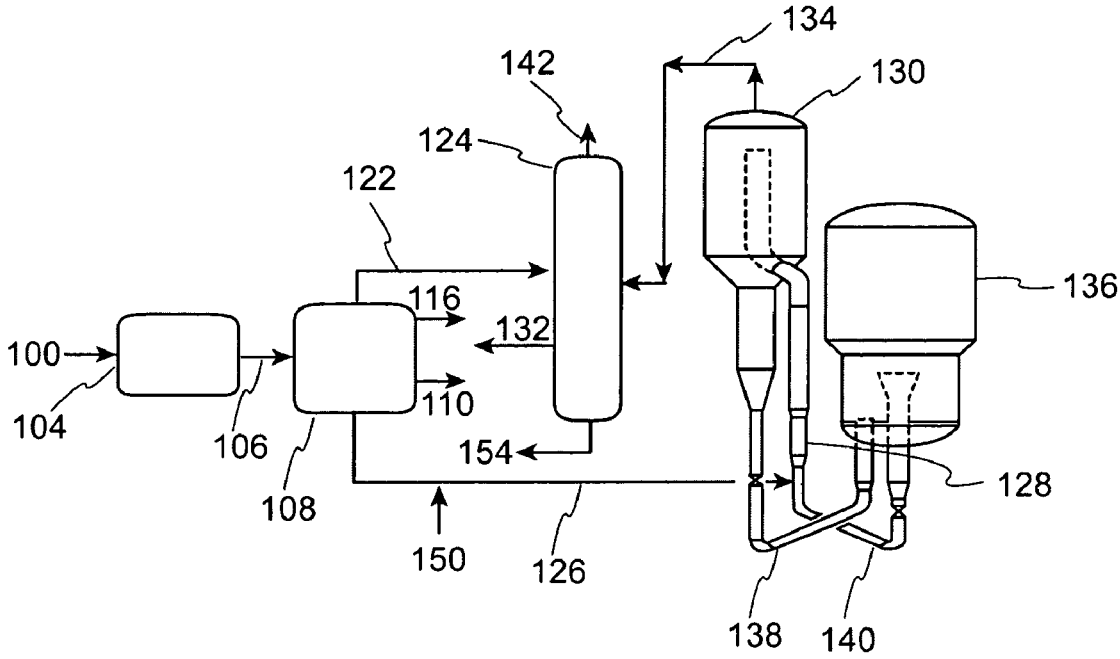
FIG. 2 is a flow diagram showing an embodiment of the present invention wherein a hydrocarbon feed is thermally cracked and sent to a distillation tower where a thermally cracked bottoms product is separated from the thermally cracked product and then further processed in a fluid catalytic cracking unit to produce an improved distillate yield.

FIG. 2 is a flow diagram showing another embodiment of the present invention in which a hydrocarbon feed is thermally cracked and sent to a distillation tower. In this embodiment, a hydrocarbon feed with a Conradson Carbon Residue ("CCR") from about 0 to about 6 wt % (100) is fed to a thermal conversion zone (104). A thermally cracked product (106) is obtained from the thermal conversion zone (104) and is sent to a distillation tower (108). A distillation tower overhead product comprising a $C_4$-fraction (122) is conducted to a fractionator (124). At least a portion of the thermally cracked bottoms product (126) is conducted to the reactor riser (128) of an FCC reactor (130) where it is cracked into lower boiling products. The FCC cracked products are separated from catalyst in cyclones (not shown) and separated cracked products (134) are conducted to the fractionator (124). Spent catalyst (138) is sent to a regenerator (136) where it is regenerated under regenerating conditions. Regenerated catalyst is returned to the reactor riser (128) through the catalyst return line (140). The fractionator (124) separates product from the FCC reactor as well as products from the distillation tower (108) into a FCC naphtha product (142), a FCC distillate product (152), and a FCC bottoms product (154). In this embodiment, the FCC naphtha product (142), is preferably drawn from the overhead of the fractionator in which case the stream may also include $C_4$-hydrocarbons, including $C_3/C_4$ olefins which can be further separated from the naphtha range hydrocarbons. In an embodiment, at least a portion of the FCC bottoms product (154) may be recycled back to the FCC reactor riser (128).

In a further embodiment, a distillation tower naphtha product stream (116) comprised of a naphtha boiling range fraction may be drawn from the distillation tower (108). In a further embodiment, at least a portion of the distillation tower naphtha product stream (116) is recycled to the FCC reactor riser (128) for further catalytic cracking. In yet another embodiment, a distillation tower distillate product stream (110) comprised of a distillate boiling range fraction may be drawn from the distillation tower (108). In other embodiments, at least a portion of the distillation tower naphtha product stream (116) can be combined with at least a portion of the FCC naphtha product stream (142) for further processing into gasoline fuel components. Similarly, in other embodiments, at least a portion of the distillation tower distillate product stream (110) can be combined with at least a portion of the FCC distillate product (152) for further processing into diesel fuel components. In an additional embodiment, the feedstream to the reactor riser (128) may be supplemented by additional FCC hydrocarbon feedstreams (150).

Figure 3:
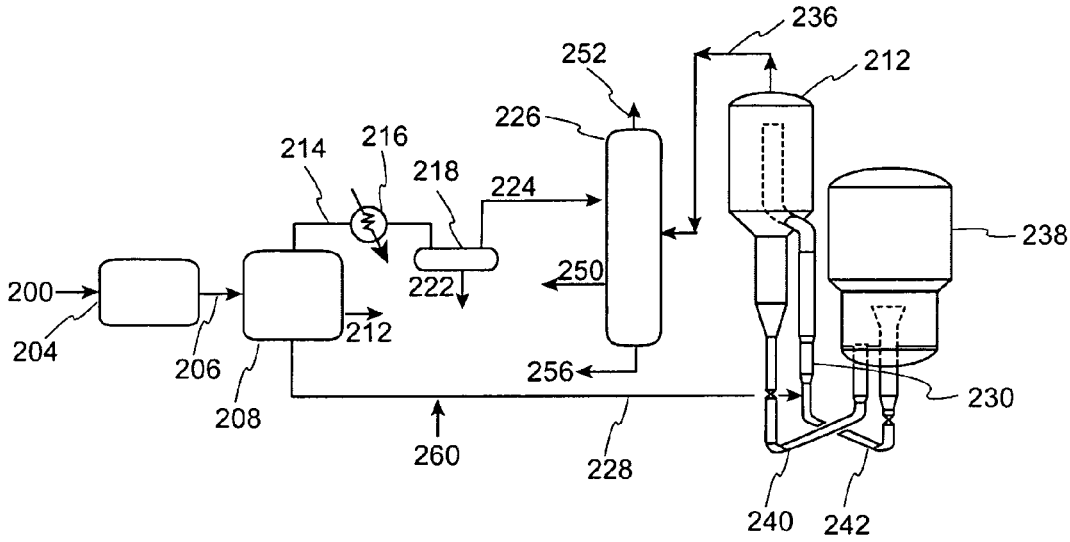
FIG. 3 is a flow diagram showing an embodiment of the present invention wherein a distillation column overhead fraction is separated from the thermally cracked product and then further separated into a $C_4$-fraction and a naphtha product fraction.

FIG. 3 is a flow diagram showing another embodiment of the present invention wherein the distillation tower overhead product is separated into a $C_4$-product fraction and a fraction comprised of a naphtha and/or distillate fraction wherein the $C_4$-product fraction is sent to the fractionator. In this embodiment, a hydrocarbon feed with a Conradson Carbon Residue ("CCR") from about 0 to about 6 wt % (200) is fed to a thermal conversion zone (204). A thermally cracked product (206) is obtained from the thermal conversion zone (204) and is sent to a distillation tower (208). A distillation tower distillate product (212) is removed from the distillation tower (208). A distillation overhead product (214) including thermally cracked naphtha and light gases including $C_4$-fraction hydrocarbons is conducted to a condenser (216) and then to a separator (218). In the separator (218), the distillation overhead product (214) is separated into a separator naphtha product (222) and a separator $C_4$-product (224). The separator $C_4$-product (224) is conducted to a fractionator (226). In an embodiment, at least a portion of the separator naphtha product (222) is recycled to the FCC reactor riser (230) for further catalytic cracking.

Continuing with FIG. 3, at least a portion of the thermally cracked bottoms product (228) is conducted to the reactor riser (230) of an FCC reactor (232) where it contacts a fluidized catalyst and is cracked into lower boiling products. The FCC cracked products are separated from catalyst in cyclones (not shown) and separated cracked products (236) are conducted to the fractionator (226). Spent catalyst (240) is sent to the regenerator (238) where it is regenerated under regenerating conditions. Regenerated catalyst is returned to reactor riser (230) through the catalyst return line (242). The fractionator (226) separates products from the FCC reactor as well as products from the distillation tower (208). These products include a fractionator naphtha product (252) and a fractionator distillate product (250). In this embodiment, the FCC naphtha product (252) is preferably drawn from the overhead of the fractionator in which case the stream may also include $C_4$-hydrocarbons, including $C_3/C_4$ olefins which can be further separated from the naphtha range hydrocarbons. A fractionator bottoms product (256) is also conducted from the fractionator (226). In an embodiment, at least a portion of the fractionator bottoms product (256) can be recycled back to the FCC reactor riser (230). In an additional embodiment, the feedstream to the reactor riser (230) may be supplemented by additional FCC hydrocarbon feedstreams (260).

The following examples will illustrate the present invention for improved distillate production by thermally cracking a hydrocarbon feed followed by catalytically cracking at least a portion of the thermally cracked product, but are not meant to limit the invention in any fashion.

EXAMPLES

Comparison to FCC only and thermal cracking plus FCC were accomplished by taking thermal cracking yields and combining them with the FCC yields. This is done by normalizing the FCC yields of the thermal bottoms by multiplying them by the weight fraction yield from the thermal cracking. The normalized bottoms distillate, gasoline and gas were then added to the yield from the thermal cracking to get the combined thermal and FCC yields. These combined vs. thermal cracked yields are presented in FIGS. 4 through 6 at the same bottoms conversion. The VGO feeds tested were a standard virgin paraffinic VGO, a naphthenic VGO and hydrotreated naphthenic VGO. All the data in the Examples show a clear shift from naphtha to distillate with process of the present invention. Mass spectrometric correlations show that a higher quality of the distillate product is obtained from the thermal cracking than from the catalytic cracking. If the thermally cracked distillate is segregated and removed prior to catalytic cracking step, it can be blended into a high quality diesel fuel. However, if the thermally cracked and the thermally cracked/catalytically cracked distillate products of the present invention are combined, the resulting diesel product still has a higher quality than typical FCC light cycle oil at the same bottoms conversion.

Example 1

General Procedure for Thermal Cracking Experiments

The general procedure for thermal cracking is set forth in this example. A 300 ml autoclave is charged with a VGO feed, flushed with nitrogen and heated to 100° C. (212° F.). The vessel is pressurized with nitrogen to about 670 psig (4,619 kPa) and pressure maintained using a mitey-mite pressure regulator. In this configuration, there is no gas flow through the autoclave, but if the pressure exceeds the set pressure, some vapors will leave the autoclave and be collected in a cooled knockout vessel downstream. The temperature is raised to the target level and the feed held at that temperature with stirring for the target time. The vessel is cooled and the pressure reduced, then purged with nitrogen for 30 minutes to remove any 343° C.− (650° F.$^-$) products that formed. These light liquids are collected in a knockout vessel cooled to 0° C. (32° F.) located downstream of the autoclave. The oil remaining in the autoclave is cooled to about 150° C. (302° F.) and filtered through #42 paper to collect and quantify any solids that may have formed. Any solids collected on the filter were washed with toluene until the filtrates were colorless.

Example 2

The procedure outlined in Example 1 was followed for the thermal treatment of a VGO. To the 300 ml autoclave, 130.0 g of a VGO feed was added, the autoclave sealed, flushed with nitrogen and heated to 100° C. (212° F.). Nitrogen was added to maintain a pressure of 670 psig (4,619 kPa). The autoclave heated to 410° C. (770° F.) and held at that temperature for 95 minutes. This is a severity of 250 equivalent seconds at 468° C. (875° F.). This corresponds to a severity of 2190 equivalent seconds at 427° C. (800° F.).

Following the procedures of Example 1, 33.5 g of light 343° C.− (650° F.$^-$) liquids were collected in the knockout vessel, 90.0 g of 343° C.+ (650° F.$^+$) liquids were collected after filtration, and 6.5 g of gas were determined (by difference). Approximately 61 w ppm of toluene insolubles were collected. The liquids had the following properties shown in Table 1.

TABLE 1

| | VGO feed | 343° C.+ | 343° C.− |
|---|---|---|---|
| % C | 85.94 | 86.61 | 85.27 |
| % H | 12.7 | 12.18 | 13.71 |
| % N | 0.08 | 0.24 | 0.00 |
| % S | 0.95 | 1.15 | 0.50 |
| MCR, % | 0.49 | 2.18 | 0 |

NOTE:
In Table 1, MCR is Microcarbon residue. Microcarbon residue is determined by test method ASTM D4530, Standard Test Method for Determination of Carbon Residue (Micro Method).

Example 3

General Procedure for Fluid Catalytic Cracking Experiments

The general method for FCC testing is set forth in this example. Base case FCC simulations were run in a P-ACE reactor from Kayser Associates equipped with a fixed bed reactor. Prior to the start of the ACE testing, the ACE feed system is flushed with toluene to minimize contamination of the system. The feed is poured into a 2 oz. bottle and placed in the ACE feed preheater to allow the feed to come to the designated preheat temperature. Once at temperature, the feed pump is calibrated to ensure that the appropriate amount of feed is injected into the reactor according to the planned feed injection rate. The chosen FCC catalyst is charged into the unit according to the established procedures. Once the catalyst has been charged, the ACE unit runs are initiated. Each catalyst charge results in six separate experiments that are sequentially run during the course of the day. During a run, the feed is injected into the fluidized bed for the designated reaction time depending on the chosen catalyst/oil ratio and feed rate. Each of the liquid products is collected in one of six knock out flasks which are maintained at −5° F. (20.5° C.). The gaseous ($C_{6-}$) products are analyzed directly by gas chromatography, and the liquid products are separately weighed and analyzed by simulated distillation. The coke on the catalyst is burned in-situ and quantified with an on-line $CO_2$ analyzer. The liquid and gas analyzed results are then pulled together and analyzed to produce the final run report.

Example 4

The 343° C.+(650° F.$^+$) liquids prepared and described in Example 2 were subjected to ACE testing to compare its reactivity to FCC relative to the starting VGO feed. The run conditions were as follows: feed rate=1.33 g/min (@ 150° F./66° C.), and cat/oil ratios of 3.0, 5.0, and 7.0. Two temperatures, 524° C. (975° F.) and 554° C. (1030° F.) were investigated. The catalyst used was an e-cat representative of an equilibrium FCC catalyst. A summary of representative data (4 runs total) is provided in the following table. The data are presented in pairs to emphasize the comparison of the results obtained by catalytic cracking alone versus those obtained by the combined thermal and catalytic cracking processes. The combined thermal treatment runs have been renormalized to include the liquid and gas products produced during the thermal treatment. The results are shown in Table 2.

TABLE 2

| | Catalytic Treating Only | Combined Thermal & Catalytic Treating | Catalytic Treating Only | Combined Thermal & Catalytic Treating |
|---|---|---|---|---|
| | Run Number | | | |
| | 1 | 2 | 3 | 4 |
| Feedstock | VGO | VGO | VGO | VGO |
| Cracking temperature, deg. F. | 1033.3 | 1031 | 1033.3 | 1032.4 |
| Feed injection time, sec. | 32 | 32 | 45 | 45 |
| Feed injector ID | 1.125 | 1.125 | 1.125 | 1.125 |
| Regen temperature, deg. F. | 1250 | 1250 | 1250 | 1250 |
| Reduction step (yes/no) | NO | NO | NO | NO |
| Catalyst/Oil ratio | 7.1 | 7.1 | 5.0 | 5.0 |
| Relative contact time | 0.5 | 0.5 | 0.5 | 0.5 |
| Conversion, 430 deg. F. | 73.4 | 64.2 | 72.1 | 62.7 |
| Conversion, 650 deg F. | 87.2 | 85.3 | 86.4 | 84.3 |
| Yields, wt % FF (1) | | | | |
| H2S | 0.37 | 0.32 | 0.37 | 0.32 |
| H2 | 0.18 | 0.17 | 0.17 | 0.16 |
| CH4 | 0.95 | 0.83 | 0.90 | 0.81 |
| C2H4 | 0.83 | 0.62 | 0.78 | 0.58 |
| C2H6 | 0.51 | 0.45 | 0.52 | 0.47 |
| C3H6 | 6.15 | 3.86 | 5.96 | 3.70 |
| C3H8 | 1.14 | 0.79 | 1.10 | 0.75 |
| Butadiene | 0.06 | 0.05 | 0.07 | 0.05 |
| Butene-1 | 1.46 | 0.92 | 1.53 | 0.96 |
| i-Butene | 2.10 | 1.21 | 2.15 | 1.25 |
| t-2-Butene | 1.94 | 1.21 | 2.01 | 1.23 |
| c-2-Butene | 1.40 | 0.88 | 1.46 | 0.89 |
| i-Butane | 3.83 | 2.27 | 3.66 | 2.06 |
| n-Butane | 0.89 | 0.58 | 0.88 | 0.56 |
| C5-430 | 46.98 | 41.25 | 47.15 | 41.04 |
| LCCO | 13.78 | 21.04 | 14.29 | 21.60 |
| BTMS | 12.84 | 14.74 | 13.57 | 15.74 |
| Coke | 4.59 | 5.29 | 3.44 | 4.31 |
| Dry gas | 2.84 | 2.39 | 2.75 | 2.35 |
| Total butenes | 6.96 | 4.26 | 7.22 | 4.38 |
| Material balance, wt % FF | 101.20 | 103.50 | 101.80 | 101.30 |

Figure 4:
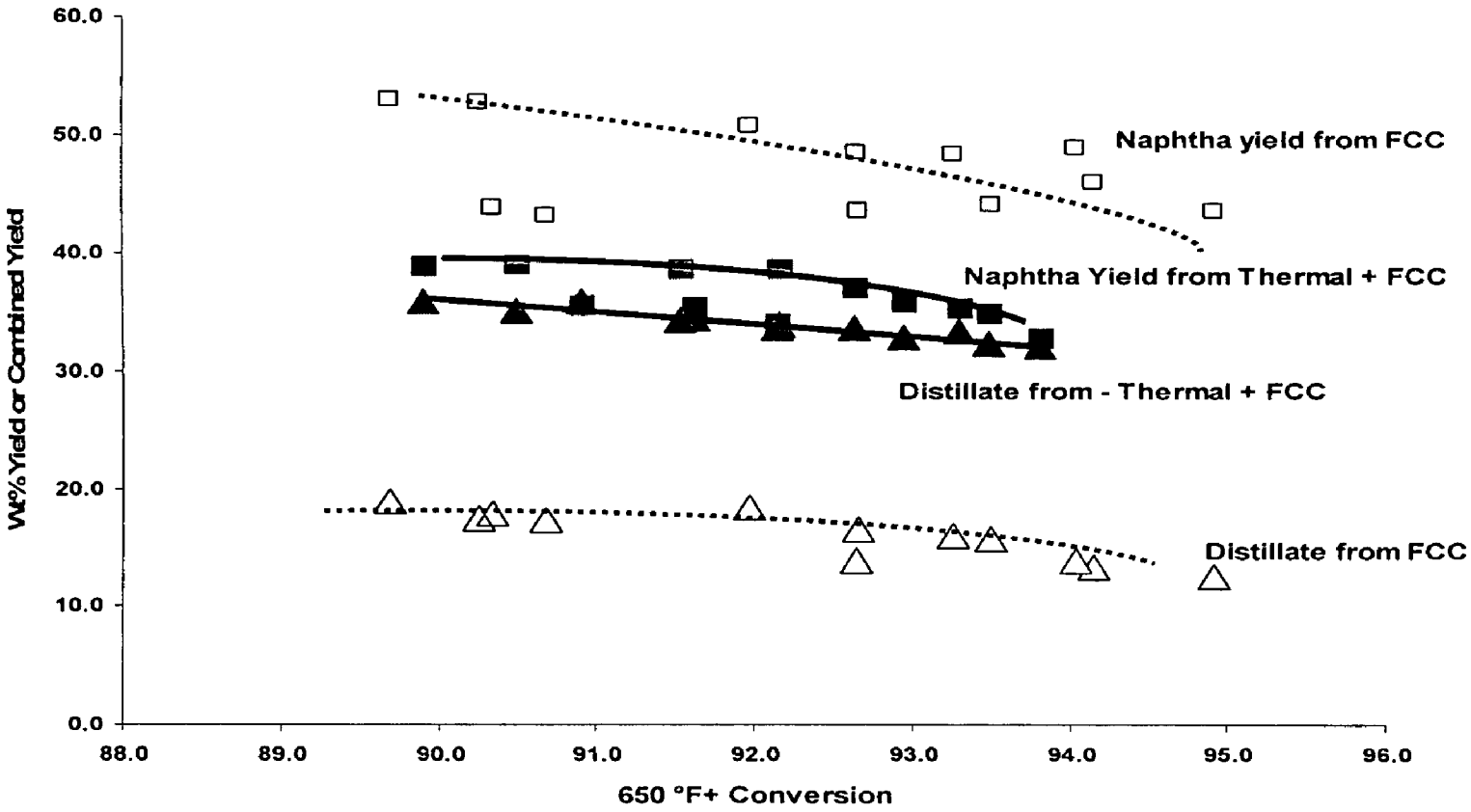
FIG. 4 is a graph showing a comparison of naphtha and distillate yields from a catalytically cracked only paraffinic VGO feed vs. a thermally cracked and catalytically cracked paraffinic VGO feed of the present invention.

NOTE
(1) Combined Thermal & Catalytic Treating data of Runs 2 and 4 have been renormalized FIG. 4 illustrates the comparison of results from a catalytically treated only paraffinic VGO and the thermally treated+catalytically cracked paraffinic VGO of the present invention. In FIG. 4, the darker curves (solid lines & solid data points) show the resulting naphtha and distillate yields from the process of the present invention. The lighter curves (dashed lines & hollow data points) show the resulting naphtha and distillate yields from catalytic cracking processing only. As can be seen in FIG. 4, the naphtha yield from present invention has been significantly reduced and the distillate yield from the present invention has been significantly increased resulting in a significantly improved distillate production from the process of the present invention. Also, while not shown in FIG. 4, the coke bottoms and $C_4$-yields were not significantly different from the between the two processes.

Example 5

A naphthenic VGO was treated as described in Examples 1-4.

Figure 5:
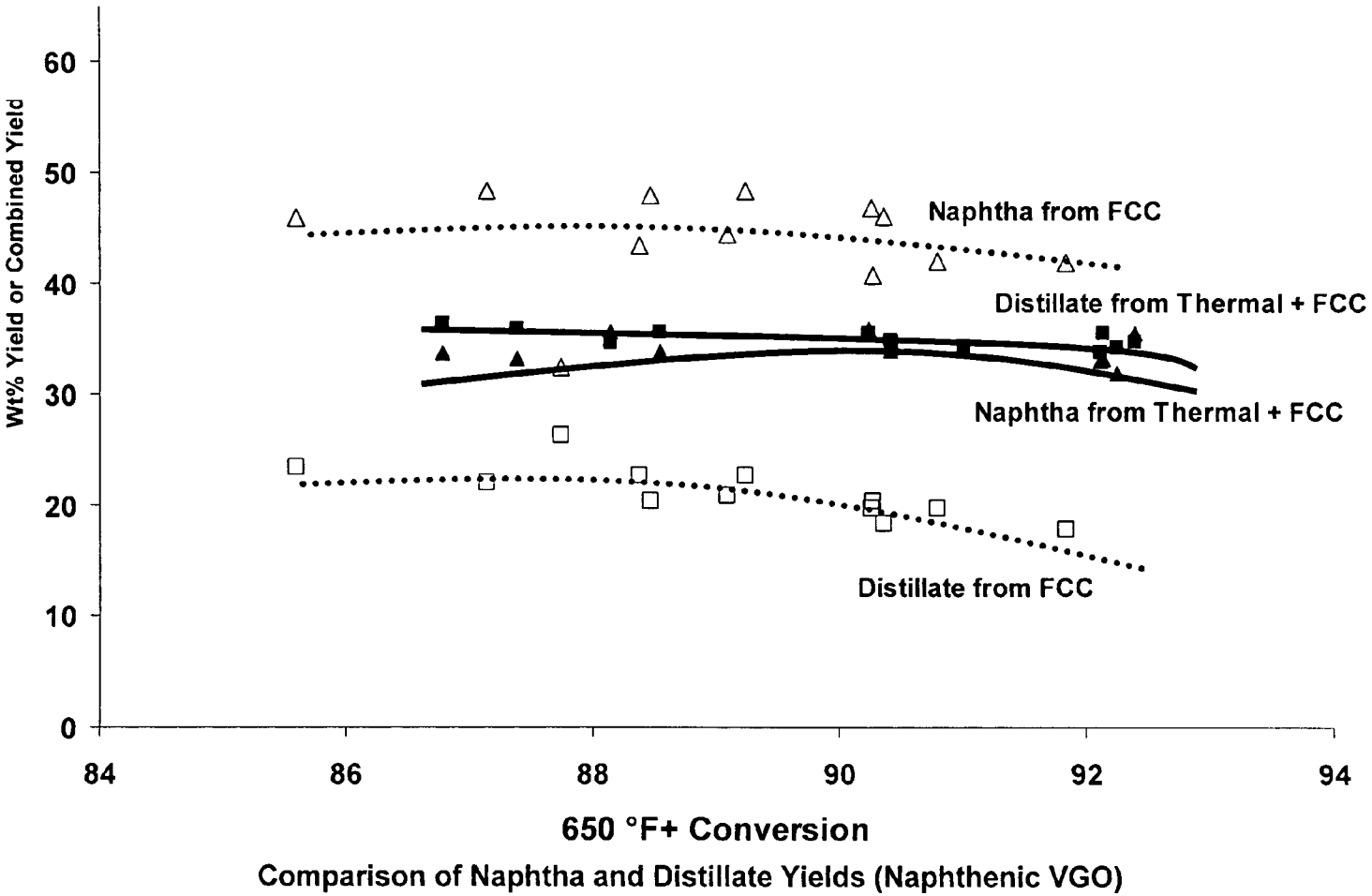
FIG. 5 is a graph showing a comparison of naphtha and distillate yields from a catalytically cracked only naphthenic VGO feed vs. a thermally cracked and catalytically cracked naphthenic VGO feed of the present invention.

FIG. 5 illustrates the comparison of results from a catalytically treated only naphthenic VGO and a thermally treated+catalytically cracked naphthenic VGO of the present invention. In FIG. 5, the darker curves (solid lines & solid data points) show the resulting naphtha and distillate yields from the process of the present invention. The lighter curves (dashed lines & hollow data points) show the resulting naphtha and distillate yields from catalytic cracking processing only. As can be seen in FIG. 5, the naphtha yield from present invention has been significantly reduced and the distillate yield from the present invention has been significantly increased resulting in a significantly improved distillate production from the process of the present invention. Also, while not shown in FIG. 5, the coke bottoms and $C_4$-yields were not significantly different from the between the two processes.

Example 6

In this example, the naphthenic VGO of Example 5 was hydrotreated under standard hydrodesulfurization conditions and the product VGO from the hydrotreating was treated as in Examples 1-4.

Figure 6:
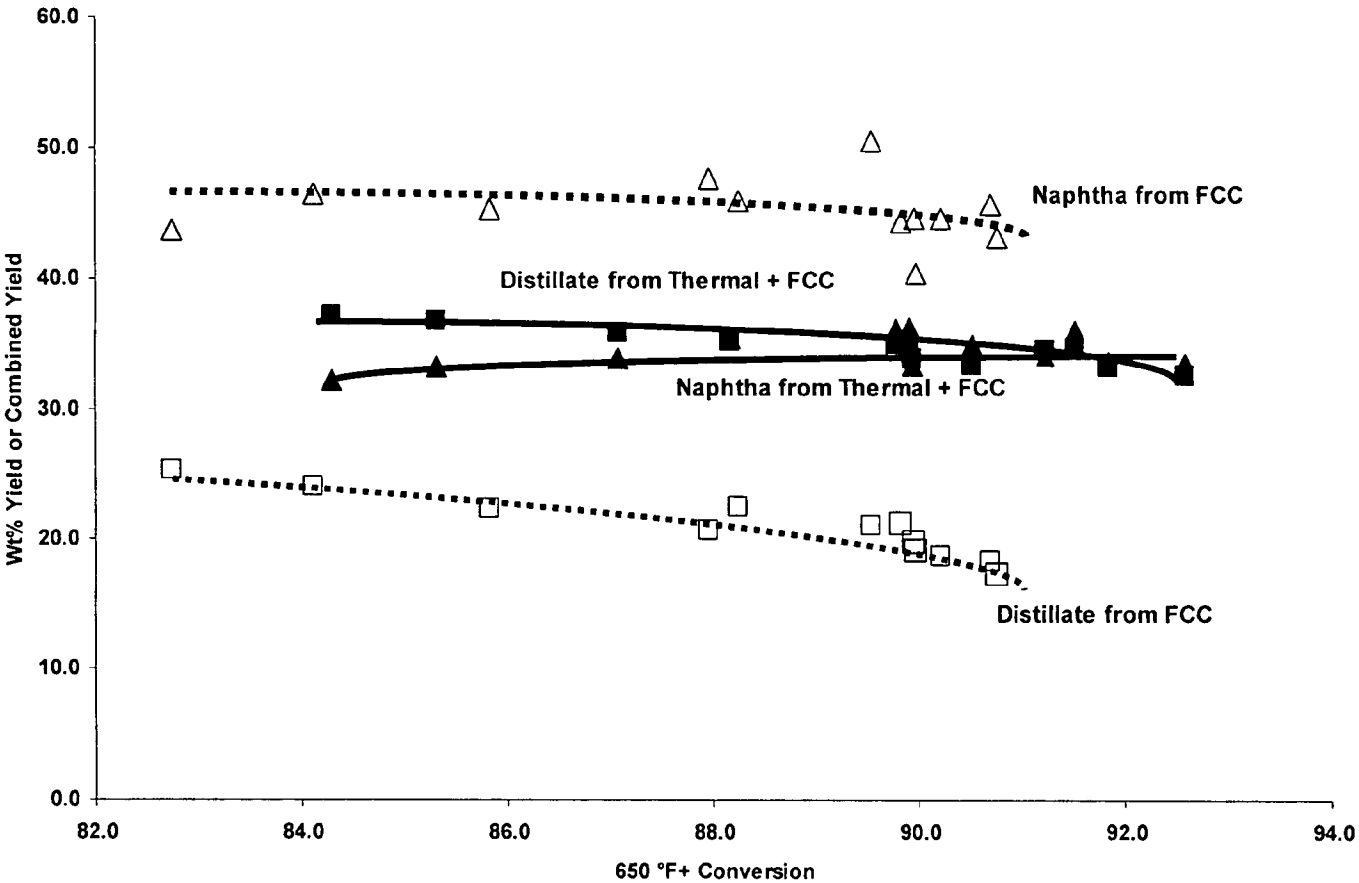
FIG. 6 is a graph showing a comparison of naphtha and distillate yields from a catalytically cracked only hydrotreated naphthenic VGO feed vs. a thermally cracked and catalytically cracked hydrotreated naphthenic VGO feed of the present invention.

FIG. 6 illustrates the comparison of results from a catalytically cracked only hydrotreated naphthenic VGO and a thermally treated+catalytically cracked hydrotreated naphthenic VGO of the present invention. In FIG. 6, the darker curves (solid lines & solid data points) show the resulting naphtha and distillate yields from the process of the present invention. The lighter curves (dashed lines & hollow data points) show the resulting naphtha and distillate yields from a catalytic cracking processing (w/prior hydrotreating) only. As can be seen in FIG. 6, the naphtha yield from present invention has been significantly reduced and the distillate yield from the present invention has been significantly increased resulting in a significantly improved distillate production from the process of the present invention. Also, while not shown in FIG. 6, the coke bottoms and $C_4$-yields were not significantly different from the between the two processes.

What is claimed is:

1. A thermal and catalytic conversion process for converting a hydrocarbon feed having a Conradson Carbon Residue ("CCR") content of from 0 to 6 wt %, based on the hydrocarbon feed, which comprises:

a) processing the hydrocarbon feed in a thermal conversion zone under effective thermal conversion conditions to produce a thermally cracked product;

b) separating the thermally cracked product into a thermally cracked bottoms fraction and a lower boiling fraction containing at least one of naphtha and distillate;

c) conducting at least a portion of the lower boiling fraction to a fractionator;

d) conducting at least a portion of the thermally cracked bottoms fraction to a reactor riser of a fluid catalytic cracking unit where it contacts a cracking catalyst;

e) catalytically converting the thermally cracked bottoms fraction under fluid catalytic cracking conditions to produce a catalytically cracked product;

f) conducting the catalytically cracked product to the fractionator; and g) separating a naphtha product, a distillate product, and a fractionator bottoms product from the fractionator.

2. The process of claim 1, wherein the thermally cracked product is separated in a flash tower.

3. The process of claim 1, wherein the thermally cracked product is separated in a distillation tower.

4. The process of claim 3, wherein a distillation tower naphtha product stream comprised of a naphtha boiling range fraction is removed from the distillation tower.

5. The process of claim 4, wherein at least a portion of the distillation tower overhead product stream is sent to the fractionator.

6. The process of claim 3, wherein a distillation tower distillate product stream comprised of a distillate boiling range fraction is removed from the distillation tower.

7. The process of claim 3, wherein a distillation tower overhead product is removed from the distillation tower, and at least a portion of the distillation tower overhead product is separated into a separator naphtha fraction product and a separator $C_{4-}$ fraction product, and at least a portion of the separator $C_{4-}$ fraction product is sent to the fractionator.

8. The process of claim 1, wherein at least a portion of the hydrocarbon feed is hydrotreated prior to processing in the thermal conversion zone.

9. The process of claim 8, wherein the hydrocarbon feed is hydrotreated in the presence of hydrogen and a hydrotreating catalyst comprised of a Group 6 and a Group 8-10 metal at a temperature of about 280° C. to about 400° C. (536 to 752° F.) and a pressure of about 1,480 to about 20,786 kPa (200 to 3,000 psig).

10. The process of claim 1, wherein at least a portion of the thermally cracked bottoms fraction is hydrotreated prior to being conducted to the reactor riser.

11. The process of claim 10, wherein the thermally cracked bottoms is hydrotreated in the presence of hydrogen and a hydrotreating catalyst comprised of a Group 6 and a Group 8-10 metal at a temperature of about 280° C. to about 400° C. (536 to 752° F.) and a pressure of about 1,480 to about 20,786 kPa (200 to 3,000 psig).

12. The process of claim 1, wherein the hydrocarbon feed comprised of a vacuum gas oil.

13. The process of claim 1, wherein the thermally cracked bottoms fraction is comprised of a distillate fraction.

14. The process of claim 1, wherein the lower boiling fraction is comprised of a naphtha fraction.

15. The process of claim 1, wherein at least a portion of the fractionator bottoms product is recycled back to the reactor riser.

16. The process of claim 1, wherein at least a portion of the naphtha product is recycled back to the reactor riser.

17. The process of claim 1, wherein the cracking catalyst includes ZSM-5.

18. The process of claim 1, wherein the thermally cracked bottoms fraction contacts the cracking catalyst at a reaction temperature of about 482° C. to about 740° C. (900 to 1364° F.), a hydrocarbon partial pressure from about 10 to about 40 psia (69 to 276 kPa), and a catalyst to feed (wt/wt) ratio from about 3 to about 10.

19. The process of claim 1, wherein the thermal conversion zone is operated at a severity in the range of 25-450 equivalent seconds at 468° C.

* * * * *